US005176875A

United States Patent [19]

Kanazumi et al.

[11] Patent Number: 5,176,875

[45] Date of Patent: Jan. 5, 1993

[54] TUBULAR WATER-COOLED JACKET FOR FURNACES

[75] Inventors: Hisao Kanazumi; Kenji Fujimori, both of Kagawa, Japan

[73] Assignee: Mitsubishi Materials Corporation, Tokyo, Japan

[21] Appl. No.: 794,509

[22] Filed: Nov. 19, 1991

[30] Foreign Application Priority Data

Nov. 20, 1990 [JP] Japan ..... 2-314684
Nov. 20, 1990 [JP] Japan ..... 2-314688

[51] Int. Cl.[5] ..... C21C 5/46

[52] U.S. Cl. ..... 266/241; 266/267; 266/268; 266/269; 266/270

[58] Field of Search ..... 266/267-270, 266/241

[56] References Cited

U.S. PATENT DOCUMENTS 3,719,355 3/1973 Suette ..... 266/241

*Primary Examiner*—Peter D. Rosenberg
*Attorney, Agent, or Firm*—Oblon, Spivak, McClelland, Maier & Neustadt

[57] ABSTRACT

A tubular water-cooled jacket for furnaces is disclosed which includes a tubular member having a plurality of axial apertures and a plurality of transverse apertures. Each transverse aperture is formed therein so as to bring at least two of the axial apertures into open comunication with each other. The plurality of axial apertures and the plurality of transverse apertures corporate with one another to define a plurality of fluid passageways for cooling water isolated from one another. Each of the fluid passageways may be defined by at least two of the axial apertures and at least one of the transverse apertures connected to the at least two axial apertures. The tubular member may include a plurality of segments arranged side-by-side in a circumferential direction thereof and joined together.

17 Claims, 3 Drawing Sheets

TUBULAR WATER-COOLED JACKET FOR FURNACES

BACKGROUND OF THE INVENTION

1. Field of the Invention

The present invention relates to a tubular water-cooled jacket for furnaces which is, for example, disposed around the burner in a metallurgical furnace.

2. Prior Art

In a metallurgical furnace equipped with a burner for maintaining the temperature of melt contained therein, the furnace wall portion, through which the burner is inserted, is susceptible to damage since this portion is exposed to extremely high temperatures due to the heat from the burner. For this reason, a tubular water-cooled jacket, in which cooling water is circulated, is interposed between the burner and the furnace wall to prevent the furnace wall from becoming superheated.

Conventional tubular water-cooled jackets of the type described above have been manufactured by shaping a metal pipe into a coil and casting metal therearound.

However, the conventional water-cooled jacket is of an intricate structure, and great care and effort are required to cast metal into a form such that the coiled pipe is situated in a proper position in the jacket, thereby increasing the manufacturing costs.

Furthermore, in the conventional tubular water-cooled jacket, the jacket is disposed around the metal pipe which defines a fluid passageway for cooling water, and hence the enlargement of the cross-section of the fluid passageway is limited due to the thickness of the pipe. Furthermore, inasmuch as the inlet and the outlet for cooling water must be formed at the same end of the jacket, the fluid passageway must be elongated in order to ensure the cooling of the entire jacket. However, with such a narrow and elongated fluid passageway, water circulating therethrough is easily heated by the burner while flowing therethrough, so that a sufficient cooling effect cannot be ensured.

SUMMARY OF THE INVENTION

It is therefore an object and feature of the present invention to provide a novel tubular water-cooled jacket for furnaces which exhibits an excellent cooling efficiency while preventing superheating of the cooling water.

Another object and feature of the invention is to provide a tubular water-cooled jacket for furnaces which can be easily manufactured at substantially reduced cost.

According to the present invention, there is provided a tubular water-cooled jacket for furnaces comprising a tubular member having a plurality of axial apertures formed therein so as to extend axially thereof and a plurality of transverse apertures each formed therein so as to bring at least two of the axial apertures into open communication with each other, the plurality of axial apertures and the plurality of transverse apertures cooperating with one another to define a plurality of fluid passageways for cooling water isolated from one another.

In the foregoing, each of the fluid passageways may be defined by at least two of the axial apertures and at least one of the transverse apertures connected to the at least two axial apertures.

Furthermore, the tubular member may comprise a plurality of segments arranged in side-by-side fashion in a circumferential direction thereof and joined together, and each of the segments may include at least one of the fluid passageways.

DESCRIPTION OF PREFERRED EMBODIMENTS OF THE INVENTION

FIGS. 1 to 6 depict a tubular water-cooled jacket for furnaces in accordance with an embodiment of the present invention.

Figure 2:
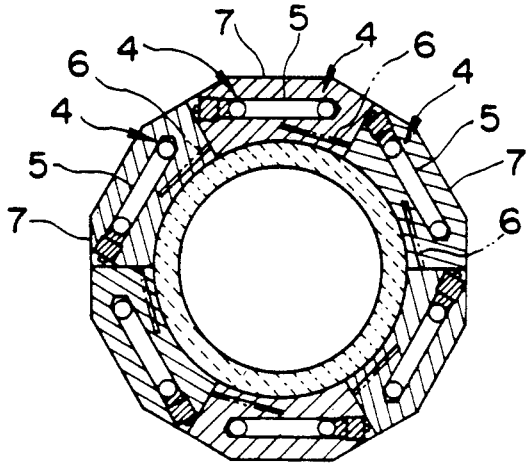
FIG. 2 is a cross-sectional view of the jacket of FIG. 1 taken along the line II—II in FIG. 1.
Figure 3:
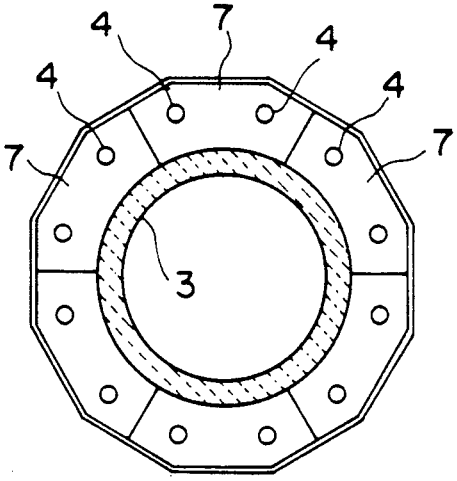
FIG. 3 is a cross-sectional view of the jacket of FIG. 1 taken along the line III—III in FIG. 1.
Figure 4:
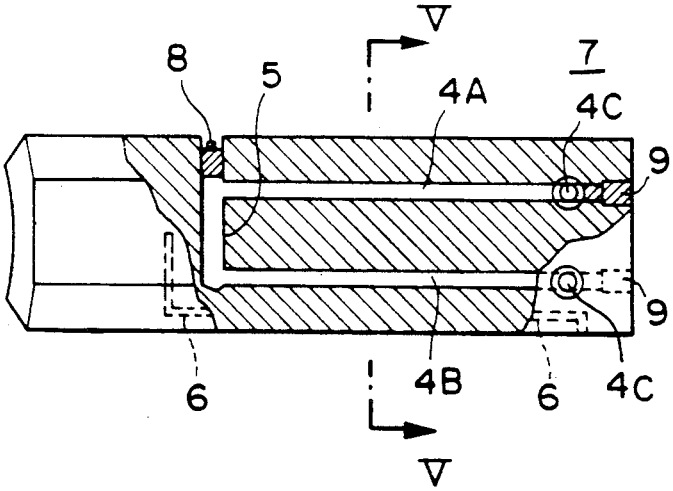
FIG. 4 is a partially cut-away side elevational view of a segment used in the jacket of FIG. 1.
Figure 5:
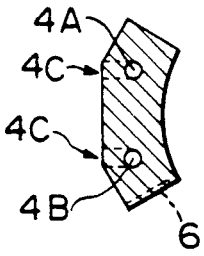
FIG. 5 is a cross-sectional view of the segment of FIG. 4 taken along the line V—V in FIG. 4.
Figure 6:
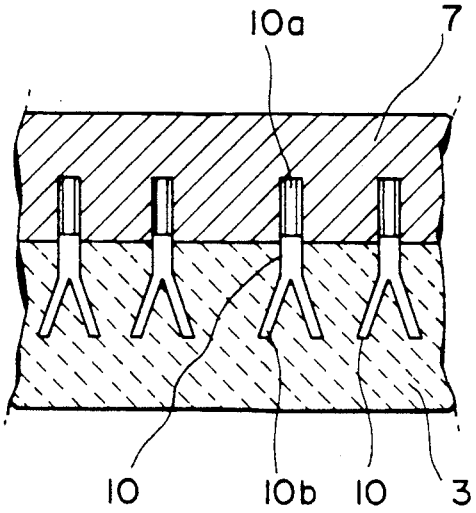
FIG. 6 is an enlarged cross-sectional view of a part of a wall portion of the jacket of FIG. 1.

The tubular water-cooled jacket includes a tubular member 1 of metal which is composed of a plurality of segments 7 of an arcuate plate-like cross-section arranged in side-by-side fashion in a circumferential direction and joined together. In the illustrated embodiment, the number of the segments is six. An annular flange 2 is mounted at a proximal end of the tubular member 1, whereas the distal end of the tubular member 1 is formed in an inclined manner with respect to and axis thereof. As best shown in FIGS. 2 and 3, the tubular member 1 has an inner surface of a circular cross-section and an outer surface formed coaxial with the inner surface and having a dodecagonal cross-section.

Furthermore, the inner surface and the end face of the distal end of the tubular member 1 are lined with castable refractories in a predetermined thickness. As will be seen from FIG. 6 which depicts the lining structure, a plurality of caster pins 10 are secured to the inner surface and the end face of the tubular member 1 with externally threaded portions 10*a* being threaded thereinto, and a plurality of castable refractories 3 are cast and set thereon such that they are engaged by Y-shaped ends 10*b* of the caster pins 10. It is preferable that the caster pins 10 be made of the same kind of metal as the tubular member 1. For example, when the tubular member 1 is formed of copper, the caster pins 10 should be preferably made of pure copper or copper-based alloy. The pure copper may be tough pitch copper, phosphor deoxidized copper, or oxygen-free copper, whereas the copper-based alloy may be brass, bronze or the like.

The tubular member 1 is provided with a plurality of fluid passageways, isolated from one another, for circulating cooling water therethrough. The tubular member 1 has a plurality of axial apertures 4 formed therein so as to extend axially thereof and a plurality of transverse apertures 5 formed therein so as to bring at least two of the axial apertures 4 into fluid communication with each other, and each of the fluid passageways is defined by at least two of the axial apertures 4 and at least one of the transverse apertures 5 connected to the at least two axial apertures 4. More specifically, in the illustrated embodiment, each segment 7 of the tubular member 1 includes two axial apertures 4 disposed in transversely spaced relation to each other, and the foremost ends of the two axial apertures 4A and 4B are in open communication with each other through the transverse aperture 5. The adjacent two axial apertures 4A and 4B and the transverse aperture 5 connected thereto define a respective fluid passageway of a channel shape, and thus six channel-shaped fluid passageways for cooling water are formed in the tubular member 1 so as to be circumferentially generally equally spaced relation to one another. Additionally, grooves 6 are formed in the tubular member 1, and thermometers are received therein to detect the superheating of the jacket.

When manufacturing a tubular water-cooled jacket as described above, six segments 7, which are to be combined together to define the tubular member 1, are first prepared. Then, two axial apertures 4A and 4B are formed from the proximal end so as to reach sufficiently inward portions of each segment 7, and a transverse aperture 5 is formed from a side surface in a direction perpendicular to the axis so as to intersect with the inner end of one of the axial aperture 4A and reach the inner end of the other axial aperture 4B. Then, the open end of the transverse aperture 5 is sealed by a plug pin 8 threaded thereinto. Furthermore, plug pins 9 and 9 are also threaded into the open ends of the two axial apertures 4A and 4B, respectively, and two holes 4C and 4C serving as inlet and outlet for cooling water are formed from the outer surface of the segment 7 to reach the ends of the axial apertures 4A and 4B, respectively. Thus, a fluid passageway of a channel shape is formed in each tubular member 1.

Figure 1:
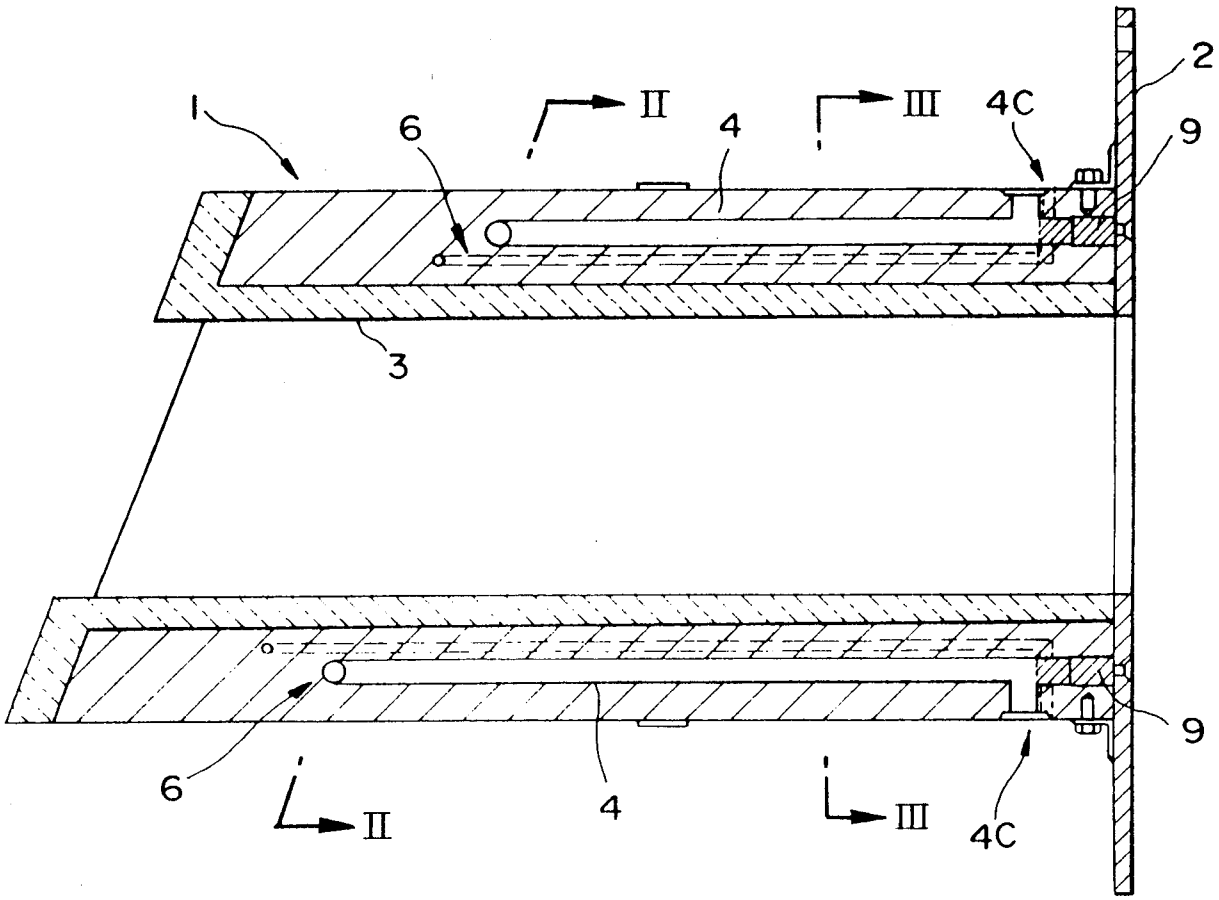
FIG. 1 is a cross-sectional view of a tubular water-cooled jacket for furnaces in accordance with the present invention.

Six segments 7 thus formed are joined together with the side faces being mated, to provide the tubular member 1, and the annular flange 2 is then fixedly secured to the proximal end thereof. Then, the tubular member 1 is lined with castable refractories 3, to provide a water-cooled jacket as shown in FIGS. 1 to 3.

In the tubular water-cooled jacket thus manufactured, cooling water, introduced from one of the holes 4C, flows through the axial aperture 4A, the transverse aperture 5, and the axial aperture 4B, and is discharged from the other hole 4C. With this circulation of cooling water, those portions adjacent to the fluid passageways, and hence the entire tubular member 1, are cooled.

As described above, in the tubular water-cooled jacket of the invention, it is possible to form the fluid passageways for cooling water by means of a drill or the like. Hence, as compared with the prior art jacket using the metal pipe, the cross-section of the fluid passageway can be enlarged by the thickness of the pipe. In addition, since the tubular member 1 is composed of a plurality of segments 7, the length of each fluid passageway can be substantially reduced, so that the cooling water is discharged well before it is superheated. Therefore, a low temperature of the circulating cooling water can be maintained, and hence high cooling effect of this jacket can be ensured.

Furthermore, since the transverse aperture 5 can be formed from the side face of the segment 7 by feeding the drill bit thereinto, the cutting lips of the drill bit are less susceptible to damage, and the apertures can be easily formed with precision. Particularly, in the case where the diameter of the tubular member 1 is relatively large, the angle defined between the transverse aperture 5 and the side face of the segment can be made close to a right angle, so that the formation of the transverse apertures 5 can be further facilitated.

Furthermore, the tubular member 1 of the water-cooled jacket of the invention is formed by joining the segments 7 together. Therefore, in the case where the jacket is heavy and large, the segments 7 may be conveyed to a position near the furnace, and the tubular member may be assembled at that position. Accordingly, the labor for the installation of the water-cooled jacket can be substantially reduced.

Moreover, if the caster pins 10 are composed of a metal which is different from that of the tubular member 1, galvanic action will occur therebetween, resulting in the engaging portion between the tubular member 1 and the caster pins 10 being subjected to galvanic corrosion. However, in the above-illustrated embodiment, the caster pins 10 are made of the same kind of metal as the tubular member 1. Therefore, galvanic corrosion can be prevented from occurring. Furthermore, when the tubular member 1 as well as the caster pins 10 are made of copper having a high heat transfer coefficient, the heat transmitted from the burner to the caster pins 10 can be efficiently dissipated into the tubular member 1, so that the caster pins 10 are prevented from being heated unduly.

Obviously, many modifications and variations of the present invention are possible in the light of the above teachings. For example, the number of the segments may be changed, and the shape of the segments may be modified so as to be, for example, of a rectangular cross-section. In addition, segments of different sizes and shapes may be joined together. Furthermore, the number of axial apertures and transverse apertures for defining a fluid passageway may be modified.

What is claimed is:

1. A tubular water-cooled jacket for furnaces comprising a tubular member having a plurality of axial apertures formed therein so as to extend axially thereof and a plurality of transverse apertures each formed therein so as to bring at least two of said axial apertures into open communication with each other, said plurality of axial apertures and said plurality of transverse apertures cooperating with one another to define a plurality of fluid passageways for cooling water isolated from one another;

wherein said tubular member comprises a plurality of segments arranged side-by-side in a circumferential direction thereof and joined together.

2. A tubular water-cooled jacket for furnaces as recited in claim 1, wherein each of said fluid passageways is defined by at least two of said axial apertures and at least one of said transverse apertures connected to said at least two axial apertures.

3. A tubular water-cooled jacket for furnaces as recited in claim 1, wherein each of said segments includes at least one of said fluid passageways.

4. A tubular water-cooled jacket for furnaces as recited in claim 3, wherein each of said segments includes an outer surface defining a part of the outer periphery of said tubular member, each of said fluid passageways including an inlet and an outlet both opening to said outer surface of said segment.

5. A tubular water-cooled jacket for furnaces as recited in claim 1, wherein said tubular member includes one end having an end face inclined with respect to the axis thereof, further comprising an annular flange member mounted on the other end of said tubular member.

6. A tubular water-cooled jacket for furnaces, comprising a tubular member having a plurality of axial apertures formed therein so as to extend axially thereof and a plurality of transverse apertures each formed therein so as to bring at least two of said axial apertures into open communication with each other, said plurality of axial apertures and said plurality of transverse apertures cooperating with one another to define a plurality of fluid passageways for cooling water isolated from one another;

wherein said tubular member includes a tubular metal wall, castable refractory disposed on the inner peripheral surface of said metal wall, and a plurality of caster pins for securing said castable refractory to said metal wall, each of said caster pins being threaded at one end into said metal wall and embedded at the other end in said castable refractory, said caster pins being composed of the same kind of metal as said wall.

7. A tubular water-cooled jacket for furnaces as recited in claim 6, wherein said caster pins are made of metal selected from the group consisting of pure copper and copper-based alloy.

8. A tubular water-cooled jacket for furnaces as recited in claim 7, wherein said pure copper is selected from the group consisting of tough pitch copper, phosphor deoxidized copper, and oxygen-free copper.

9. A tubular water-cooled jacket for furnaces as recited in claim 7, wherein said copper-based alloy is selected from the group consisting of brass and bronze.

10. A water-cooled jacket extending in an axial direction and having a substantially annular cross-section, comprising:

a plurality of U-shaped fluid passageways circumferentially spaced from one another, each of said U-shaped fluid passageways including a first axial aperture adapted to receive cooling water entering said water-cooled jacket, a second axial aperture substantially parallel to said first axial aperture and having a length substantially equal to the length of said first axial aperture, and a transverse aperture, substantially perpendicular to and fluidically communicating said first and second axial apertures.

11. The water-cooled jacket according to claim 10, wherein said transverse aperture comprises a blind bore formed in said water-cooled jacket.

12. The water-cooled jacket according to claim 11, wherein said transverse aperture has an open end sealed by a plug pin threaded thereinto.

13. The water-cooled jacket according to claim 10, wherein said jacket comprises a plurality of separately formed axially extending segments, and wherein at least one of said U-shaped fluid passageways is formed within each segment.

14. The water-cooled jacket according to claim 13, wherein each segment includes a first side face for mating with a first adjacent segment and a second side face for mating with a second adjacent segment.

15. The water-cooled jacket according to claim 13, wherein each segment has a proximal end fixedly secured to an annular flange.

16. The water-cooled jacket according to claim 10, wherein said water-cooled jacket comprises an inner layer of castable refractory and an outer layer of metal.

17. The water-cooled jacket according to claim 16, wherein said inner layer of castable refractory is secured to said outer layer of metal by a plurality of caster pins.

* * * * *